United States Patent [19]

Willingham

[11] 4,393,977

[45] Jul. 19, 1983

[54] CHILD RESISTANT PACKAGE

[75] Inventor: Wendell D. Willingham, Toledo, Ohio

[73] Assignee: Owens-Illinois, Inc., Toledo, Ohio

[21] Appl. No.: 362,585

[22] Filed: Mar. 29, 1982

[51] Int. Cl.[3] ..... B65D 55/02

[52] U.S. Cl. ..... 215/211; 215/213; 215/220

[58] Field of Search ..... 215/211, 213, 219, 220, 215/222

[56] References Cited

U.S. PATENT DOCUMENTS

| | | | |
|---|---|---|---|
| 4,059,198 | 11/1977 | Mumford | 215/211 |
| 4,121,727 | 10/1978 | Robbins et al. | 215/211 |
| 4,165,813 | 8/1979 | Babiol | 215/220 |
| 4,271,971 | 6/1981 | Morris | 215/220 |

*Primary Examiner*—George T. Hall

*Attorney, Agent, or Firm*—John R. Nelson; Myron E. Click

[57] ABSTRACT

A child resistant package comprising a container and closure. The container has a side wall, a bottom wall and an open end. The closure includes an outer member and an inner member, the inner member having a portion thereof extending through an opening in the outer member such that axial pressure may be applied through this portion to move the inner member relative to the outer member in an axial direction. A liner insert sealingly engages the upper end of the container. The inner member and the liner have interengaging portions such that when the closure is removed from the container, the liner insert is also removed. A portion of the liner defines a spring between the liner and the inner member to yieldingly urging the inner member axially outwardly toward the outer member. The container has radially resilient portions on the upper end of the side wall, and the outer member includes a peripheral skirt having a rib adapted to engage the radial resilient portions on the container.

37 Claims, 4 Drawing Figures

CHILD RESISTANT PACKAGE

This invention relates to child resistant packages.

BACKGROUND AND SUMMARY OF THE INVENTION

It has been recognized that packages for medicinal and other materials should preferably be resistant to removal by children. In the most commonly utilized types of child resistant packages, the package includes a closure which requires a simultaneous application of axial pressure and rotation of the closure relative to the container. Such simultaneous movements have been very effective in providing a child resistant feature. However, they have been difficult to use by the elderly or disabled who find it difficult to make such simultaneous manipulations. Accordingly, it has been common for pharmacists to provide to the elderly or disabled an additional snap-on cap that can be used in lieu of the child resistant closure.

It has also been heretofore suggested that a closure be provided that can be used in one position as a child resistant closure and then turned over and used in a conventional manner on the container as applying by the closure by threading.

The present invention is directed to providing a child resistant package which does not require simultaneous push or axial and rotating forces; which utilizes the simple expedient of moving a part axially to unlock the closure after which it can be removed by a mere axial movement in the opposite direction; and which in the unlocked position can be utilized to reclose the container without activating the child resistant feature thereby providing an additional mode of use.

In accordance with the invention, the child resistant package comprises a container and closure. The container has a side wall, a bottom wall and an open end. The closure includes an outer member having a portion thereof extending through an opening in the outer member such that axial pressure may be applied through this portion to move the inner member relative to the outer member in an axial direction. A liner insert sealingly engages the upper end of the container. The inner member and the liner have interengaging portions such that when the closure is removed from the container, the liner insert is also removed. A portion of the liner defines a spring between the liner and the inner member to yieldingly urging the inner member axially outwardly toward the outer member. The container has radially resilient portions on the upper end of the side wall, and the outer member includes a peripheral skirt having a rib adapted to engage the radial resilient portions on the container. The inner member has an annular wall adjacent the skirt of the outer member. The annular wall has a bead thereon operable upon axial movement of the inner member toward the container to move the radially movable portions of the container and disengage them from the rib of the outer member. The wall of the inner member and and the skirt of said outer member having interengaging portions which engage upon axially outward movement of the inner member relative to the outer member so that the closure can be removed by axial movement carrying with it the outer member, the inner member and the insert.

DESCRIPTION

Figure 1:
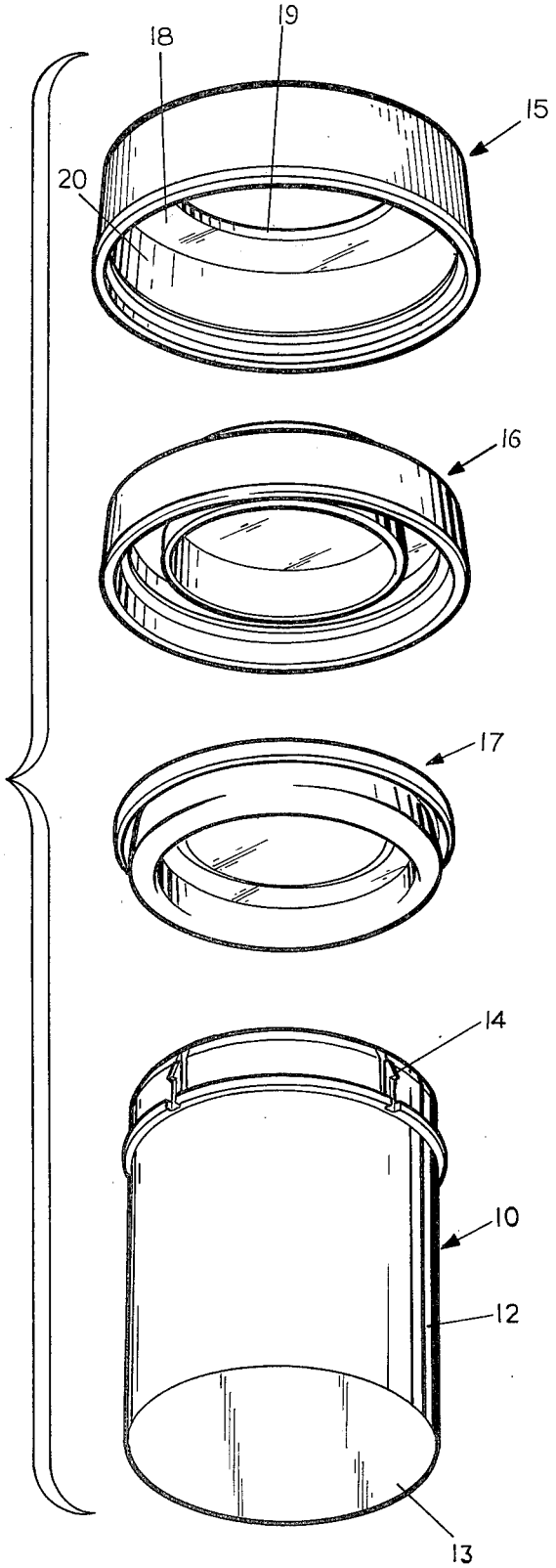
FIG. 1 is an exploded perspective view of a child resistant package embodying the invention.
Figure 2:
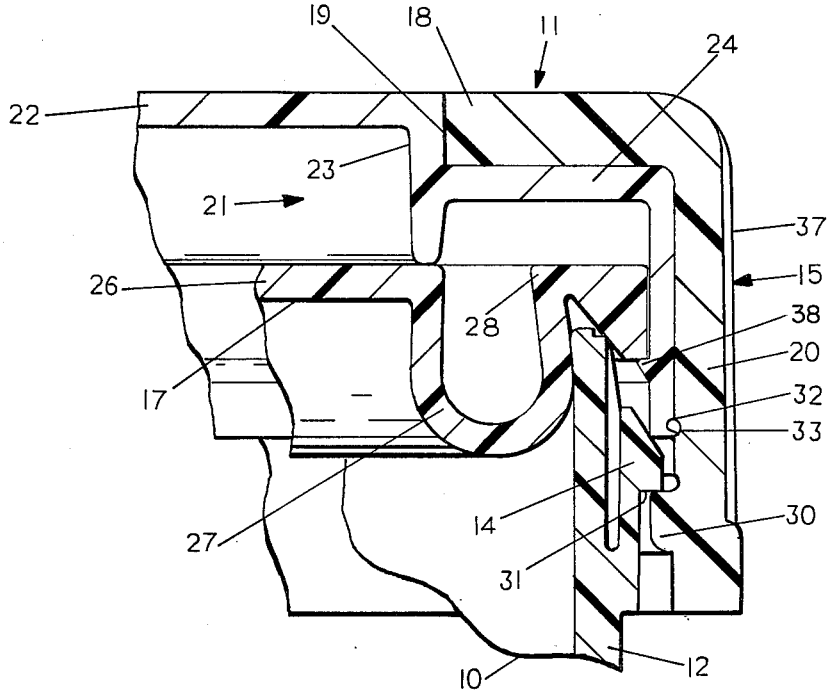
FIG. 2 is a fragmentary sectional view on an enlarged scale showing the child resistant package with the closure in locked position.

Referring to FIGS. 1 and 2, the child resistant package embodying the invention comprises a container 10 and a closure 11.

The container is made of plastic, comprises a side wall 12, a bottom wall 13, the side wall being cylindrical and having an open upper end. The container 10 is further provided along its side wall 13 with a plurality of circumferentially spaced axially extending portions 14 at the upper end that are supported in cantilever fashion so that they can flex radially inwardly. The portions 14 defining locking lugs, as presently described.

The closure 11 includes an outer member or lock ring 15 and an inner or release member 16 as well as a liner insert 17. The outer member 11 has a top wall 18 with a cylindrical opening 19 and a peripheral skirt 20. The inner member 16 includes a cylindrical portion 21 including a top wall 22 and a side wall 23 that extends upwardly into the opening 19 in the outer member 15. In the locked position the top wall 22 of portion 21 is flush with the top wall 18 of the outer member 15. The cylindrical portion 21 defines a release button for unlocking the closure, as presently described. The inner member 16 further includes an annular horizontal portion 24 extending radially outwardly from side wall 23 and an annular wall 25 that extends along the inner surface of the skirt 20 of the outer member 15.

The inner insert 17 includes a central flat portion 26, a plug portion 27 that forms an inner seal with the inner surface of the wall 12 at the upper end and also functions as a spring, and a peripheral flange 28 that overlies the upper end and extends downwardly for a short distance about the periphery of the upper end of the container.

As further shown in FIG. 2, the inner surface of the skirt 20 of the outer member 15 is formed with an annular bead 30 that engages beneath a shoulder 31 on each of the radial portions 14 to lock the closure on the container. In the position shown in FIG. 2, the outer surface of the lower end of the inner member 16 is formed with an annular bead 32 that engages an annular groove 33 spaced above the bead 30 in the inner surface of the skirt 20.

The outer member 15 and inner member 11 are preferably made of rigid plastic material such as high density polyethylene or polypropylene. The inner insert 17 is preferably made of flexible plastic such as low density polyethylene. The container is preferably made of rigid transparent or translucent plastic such as polypropylene, high density polyethylene or polystyrene.

Figure 3:
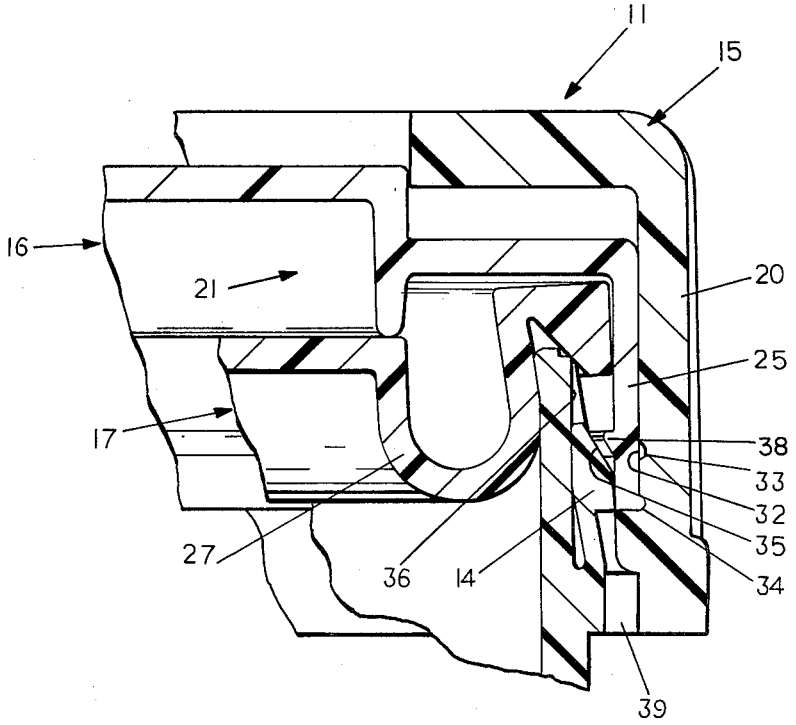
FIG. 3 is a fragmentary sectional view similar to FIG. 2 showing the closure in an unlocked position.

Referring to FIG. 3, when it is desired to remove the closure, an axial force is applied to the release button 21 moving the inner member 16 axially inwardly relative to the outer member 15 against the spring force of the portion 27 of the insert 17. This causes the lower end of the annular wall 25 of the inner member 16 to engage downwardly and outwardly tapered surfaces 35 on the upper end of the radial portions 14 camming them inwardly into grooves 36 in the side wall 12, thereby disengaging the radial portions 14 from the annular bead 30 of outer member 15. This also moves the annular wall 25 downwardly bringing the bead 32 into engagement with another annular groove 34 on the inner surface of skirt 20 positioned between the groove 33 and at the juncture of skirt 20 and bead 30. The closure is then free to be removed by merely grasping the periphery which may be formed with serrations 37. As the closure is lifted, an annular rib 38 on the inner surface of the wall 25 engages the periphery of the insert 17 to remove it with the remainder of the closure. With the closure in locked position, a protective flange 39 on the container serves as a deterrent to prying the closure off.

When it is desired to re-apply the closure, a mere axial movement is provided on the outer member and force in an axial direction causes the outer member 15 to move axially relative inwardly to the inner member 16 to relock the closure.

Figure 4:
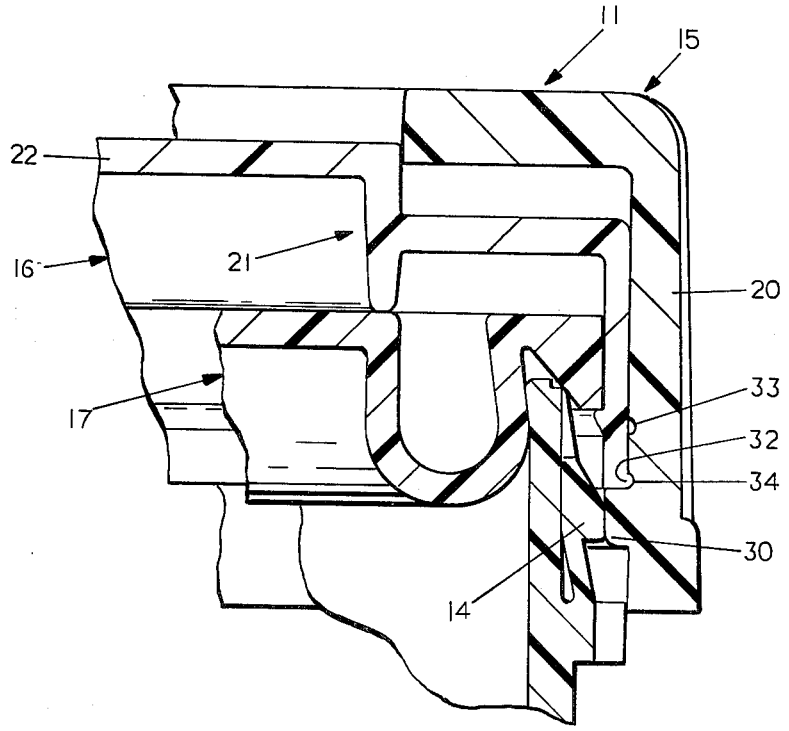
FIG. 4 is a fragmentary sectional view showing the closure for application in a non-child resistant mode.

By leaving the release button depressed as shown in FIG. 4, the closure becomes a non-child resistant closure and can be applied by simply holding the release button in the depressed position and pushing the closure onto the container. In this position, the locking lugs or portions 14 are not engaged by the bead 30, the bead 32 on the inner member 16 remains in engagement with groove 34 and the insert is not flexed on the containers.

To change a child resistant mode, it is only necessary to push the outer member or locking ring axially further until it snaps down under the locking lug on the radial portions.

It can thus be seen that there has been provided a child resistant package that requires only axial motion to open the package, that will function in a child resistant mode or a non-child resistant mode. The closure has an outer member and an inner member permitting these members to have different colors.

What is claimed is:

1. A child resistant package comprising a container having a side wall, a bottom wall and an open end, a closure including an outer member and an inner member, said inner member having a portion thereof extending through an opening in the outer member such that axial pressure may be applied through said portion to move the inner member relative to the outer member in an axial direction, a liner insert sealingly engaging the upper end of the container, interengaging means between the inner member and the liner such that when the closure is removed from the container, the liner insert is also removed, spring means between the liner and the inner member yieldingly urging the inner member axially outwardly toward the outer member, said container having radially resilient portions on the side wall, said outer member including a peripheral skirt having portions thereof adapted to engage said radial resilient portions on the container, said inner member having an annular wall adjacent the skirt of the outer member, said annular wall having means thereon operable upon axial inward movement of said inner member to move said radially movable portions of the container to disengage said portions from the portions of the outer member, said wall of said inner member and said skirt of said outer member having interengaging portions which engage upon axially inward movement of the inner member relative to the outer member so that the closure can be removed by axial movement carrying with it the outer member, and the inner member and the insert.

2. The child resistant package set forth in claim 1 wherein said radially resistent portions on the container comprise a plurality of axially upwardly extending circumferentially spaced cantilever portions, each portion having a shoulder, said portions on the skirt of said outer member adapted to engage said cantilever portions comprising an annular bead extending radially inwardly for engaging beneath said shoulders.

3. The child resistant package set forth in claims 1 or 2 wherein said annular wall of said inner member engages each resilient portion of the container when the inner member is moved axially inwardly to disengage said resilient portions from said annular bead on the skirt of the outer member.

4. The child resistant package set forth in claim 3 wherein each said radially resilient portion of the container includes an inclined surface tapered radially downwardly and outwardly which is engaged by the lower edge of the annular wall of the inner member when the inner member is moved axially inwardly of the container.

5. The child resistant package set forth in claim 1 wherein said interengaging means between the annular wall of the inner member and the skirt of the outer member comprises spaced annular grooves on the inner surface of the skirt of the outer member and an annular bead on the outer surface of the annular wall of the inner member whereby said inner member is interlocked with said outer member in two positions.

6. The child resistant package set forth in claim 1 wherein interengaging means between said annular wall of said inner member and said liner insert comprise a radially inwardly extending rib adapted to engage the periphery of the liner insert and remove the insert from the container when the closure is removed from the container.

7. The child resistant package set forth in claim 1 wherein said liner insert comprises a sealing portion engaging the periphery of the open end of the container, a plug portion engaging the inner surface of the wall of the container and a central panel portion.

8. The child resistant package set forth in claim 7 wherein said plug portion defines said spring means.

9. The child resistant package set forth in claim 8 wherein said inner member includes an annular axially inwardly extending rib engaging the panel portion of the insert.

10. The child resistant package set forth in claim 1 wherein said inner member includes a generally cylindrical portion, said opening in said outer member being such that the cylindrical portion extends into said opening, said inner member including a peripheral horizontal portion connecting said annular wall and said cylindrical portion.

11. A child resistant package comprising a plastic container having a side wall, a bottom wall and an open end, a plastic closure including an outer member and an inner member, said inner member having a cylindrical portion thereof extending through an opening in the outer member such that axial pressure may be applied through said portion to move the inner member relative to the outer member in an axial direction, a plastic liner insert sealingly engaging the upper end of the container, said inner member having an annular wall with a rib on the inner surface thereof adapted to engage and the liner such that when the closure is removed from the container, the liner insert is also removed, spring means between the liner and the inner member yieldingly urging the inner member axially outwardly toward the outer member, said container having a plurality of radially resilient portions extending axially upwardly in cantilever fashion, said outer member including a peripheral skirt an annular bead on the inner surface adapted to engage said radial resilient portions on the container, said rib on said annular wall of said inner member being operable upon axial inward movement of said inner member to move said radially movable portions of the container to disengage said portions from the bead on the outer member, said skirt of said outer member having spaced annular grooves, said wall of said inner member having a complementary bead on the outer surface thereof such that the bead engages one of said grooves upon axially inward movement of the inner member relative to the outer member so that the closure can be removed and applied by axial movement of the outer member carrying with it both the outer member and the inner member and the insert.

12. The child resistant package set forth in claim 11 wherein each said resilient portion on the container has a shoulder, said bead on the skirt of said outer member extending radially inwardly for engaging beneath said shoulder.

13. The child resistant package set forth in claim 12 wherein each said radially resilient portion of the container includes an inclined surface tapered radially downwardly and outwardly which is engaged by the lower edge of the annular wall of the inner member when the inner member is moved axially inwardly of the container.

14. The child resistant package set forth in claim 11 wherein said liner insert comprises a sealing portion engaging the periphery of the open end of the container, a plug portion engaging the inner surface of the wall of the container and a central panel portion.

15. The child resistant package set forth in claim 14 wherein said plug portion defines said spring means.

16. A child resistant closure for use with a container having a side wall, a bottom wall and an open end and radially resilient portions at the upper end of said side wall, said closure including an outer member and an inner member, said inner member having a portion thereof extending through an opening in the outer member such that axial pressure may be applied through said portion to move the inner member relative to the outer member in an axial direction, a liner insert adapted to sealingly engage the upper end of the container, interengaging means between the inner member and the liner insert such that when the closure is removed from the container, the liner insert is also removed, spring means between the liner and the inner member yieldingly urging the inner member axially outwardly toward the outer member, said outer member including a peripheral skirt having portions thereof adapted to engage said radial resilient portions on the container, said inner member having an annular wall adjacent the skirt of the outer member, said annular wall having means thereon operable upon axial inward movement of said inner member to move said radially movable portions of the container to disengage said portions from the portions of the outer member, said wall of said inner member and said skirt of said outer member having interengaging portions which engage upon axially inward movement of the inner member relative to the outer member so that the closure can be removed by axial movement carrying with it both the outer member and the inner member and the insert.

17. The child resistant closure set forth in claim 15 wherein said skirt of said outer member has an annular flange extending radially inwardly adapted to engage beneath said shoulder on the resilient portion of the container.

18. The child resistant closure set forth in claim 16 wherein said interengaging means between the annular wall of the inner member and the skirt of the outer member comprises spaced annular grooves on the inner surface of the skirt and an annular bead on the outer surface of the annular wall whereby said inner member is interlocked with said outer member in two positions.

19. The child resistant closure set forth in claim 16 wherein said annular wall of said inner member has a radially inwardly extending bead adapted to engage the periphery of the liner insert and remove the insert from the container when the closure is removed from the container.

20. The child resistant closure set forth in claim 16 wherein said liner insert comprises a sealing portion adapted to engage the periphery of the open end of the container, a plug portion adapted to engage the inner surface of the wall of the container and a central panel portion.

21. The child resistant closure set forth in claim 20 wherein said plug portion defines said spring means.

22. The child resistant closure set forth in claim 16 wherein said inner member includes a generally cylindrical portion, said opening in said outer member being such that the cylindrical portion extends into said opening, said inner member including a peripheral horizontal portion connecting said annular wall and said cylindrical portion.

23. The child resistant closure set forth in claim 16 wherein said inner member includes an annular axially inwardly extending rib engaging the panel portion of the insert.

24. A child resistant closure for use with a container having a side wall, a bottom wall and an open end, and radially resilient portions at the upper end of the container, said closure being made of plastic including an outer member and an inner member, said inner member having a portion thereof extending through an opening in the outer member such that axial pressure may be applied through said portion to move the inner member relative to the outer member in an axial direction, a plastic liner insert adapted to sealingly engaging the upper end of the container, interengaging means between the inner member and the liner such that when the closure is removed from the container, the liner insert is also removed, spring means between the liner and the inner member yieldingly urging the inner member axially outwardly toward the outer member, said outer member including a peripheral skirt having an annular bead thereof adapted to engage said radial resilient portions on the container, said inner member having an annular wall adjacent the skirt of the outer member, said annular wall having a rib thereon operable upon axial inward movement of said inner member to move said radially movable portions of the container to disengage said portions from the portions of the outer member, said wall of said inner member having a bead and said skirt of said outer member having spaced annular grooves selectively engaged by said bead upon axially inward or outward movement of the inner member relative to the outer member so that the closure can be removed and applied by axial movement carrying with it the outer member and the inner member and the insert.

25. The child resistant closure set forth in claim 24 wherein said annular wall of said inner member engages each resilient portion of the container when the inner member is moved axially inwardly to disengage said resilient portions from said annular bead on the skirt of the outer member.

26. The child resistant closure set forth in claim 24 wherein said liner insert comprises a sealing portion engaging the periphery of the open end of the container, a plug portion engaging the inner surface of the wall of the container and a central panel portion.

27. The child resistant closure set forth in claim 26 wherein said plug portion defines said spring means.

28. The child resistant closure set forth in claim 24 wherein said inner member includes a generally cylindrical portion, said opening in said outer member being such that the cylindrical portion extends into said opening, said inner member including a peripheral horizontal portion connecting said annular wall and said cylindrical portion.

29. The child resistant closure set forth in claim 24 wherein said inner member includes an annular axially inwardly extending rib engaging the panel portion of the insert.

30. A child resistant package comprising a container having a side wall, a bottom wall and an open end, a closure including an outer member and an inner member, said inner member having a portion thereof extending through an opening in the outer member such that axial pressure may be applied through said portion to move the inner member relative to the outer member in an axial direction, spring means yieldingly urging the inner member axially outwardly toward the outer member, said container having radially resilient portions on the side wall, said outer member including a peripheral skirt having portions thereof adapted to engage said radial resilient portions on the container, said inner member having an annular wall adjacent the skirt of the outer member, said annular wall having means thereon operable upon axial inward movement of said inner member to move said radially movable portions of the container to disengage said portions from the portions of the outer member, said wall of said inner member and said skirt of said outer member having interengaging portions which engage upon axially inward movement of the inner member relative to the outer member so that the closure can be removed by axial movement carrying with it the outer member, and the inner member and the insert.

31. The child resistant package set forth in claim 30 wherein said radially resistant portions on the container comprise a plurality of axially upwardly extending circumferentially spaced cantilever portions, each portion having a shoulder, said portions on the skirt of said outer member adapted to engage said cantilever portions comprising an annular bead extending radially inwardly for engaging beneath said shoulders.

32. The child resistant package set forth in claims 30 or 31 wherein said annular wall of said inner member engages each resilient portion of the container when the inner member is moved axially inwardly to disengage said resilient portions from said annular bead on the skirt of the outer member.

33. The child resistant package set forth in claim 32 wherein each said radially resilient portion of the container includes an inclined surface tapered radially downwardly and outwardly which is engaged by the lower edge of the annular wall of the inner member when the inner member is moved axially inwardly of the container.

34. The child resistant package set forth in claim 30 wherein said interengaging means between the annular wall of the inner member and the skirt of the outer member comprises spaced annular grooves on the inner surface of the skirt of the outer member and an annular bead on the outer surface of the annular wall of the inner member whereby said inner member is interlocked with said outer member in two positions.

35. A child resistant closure for use with a container having a side wall, a bottom wall and an open end and radially resilient portions at the upper end of said side wall, said closure including an outer member and an inner member, said inner member having a portion thereof extending through an opening in the outer member such that axial pressure may be applied through said portion to move the inner member relative to the outer member in an axial direction, spring means yieldingly urging the inner member axially outwardly toward the outer member, said outer member including a peripheral skirt having portions thereof adapted to engage said radial resilient portions on the container, said inner member having an annular wall adjacent the skirt of the outer member, said annular wall having means thereon operable upon axial inward movement of said inner member to move said radially movable portions of the container to disengage said portions from the portions of the outer member, said wall of said inner member and said skirt of said outer member having interengaging portions which engage upon axially inward movement of the inner member relative to the outer member so that the closure can be removed by axial movement carrying with it both the outer member and the inner member and the insert.

36. The child resistant closure set forth in claim 35 wherein said skirt of said outer member has an annular flange extending radially inwardly adapted to engage beneath said shoulder on the resilient portion of the container.

37. The child resistant closure set forth in claim 35 wherein said interengaging means between the annular wall of the inner member and the skirt of the outer member comprises spaced annular grooves on the inner surface of the skirt and an annular bead on the outer surface of the annular wall whereby said inner member is interlocked with said outer member in two positions.

* * * * *